US012274339B1

(12) United States Patent
Jiang

(10) Patent No.: US 12,274,339 B1
(45) Date of Patent: Apr. 15, 2025

(54) MULTIFUNCTIONAL LUGGAGE

(71) Applicant: JKH Health Co., Ltd., Shenzhen (CN)

(72) Inventor: Pu Jiang, Shenzhen (CN)

(73) Assignee: JKH Health Co., Ltd., Shenzhen (CN)

( * ) Notice: Subject to any disclaimer, the term of this patent is extended or adjusted under 35 U.S.C. 154(b) by 0 days.

(21) Appl. No.: 18/891,922

(22) Filed: Sep. 20, 2024

(30) Foreign Application Priority Data

Oct. 19, 2023 (CN) ..... 202322815546.X
Apr. 3, 2024 (CN) ..... 202420688110.0

(51) Int. Cl.

| | |
|---|---|
| ***A45C 5/06*** | (2006.01) |
| ***A45C 5/03*** | (2006.01) |
| ***A45C 5/14*** | (2006.01) |
| ***A45C 13/00*** | (2006.01) |
| ***A45C 13/10*** | (2006.01) |
| ***A45C 13/26*** | (2006.01) |

(52) U.S. Cl.
CPC ..... *A45C 5/06* (2013.01); *A45C 5/03* (2013.01); *A45C 5/14* (2013.01); *A45C 13/008* (2013.01); *A45C 13/10* (2013.01); *A45C 13/26* (2013.01); *A45C 2005/037* (2013.01)

(58) Field of Classification Search
CPC .... A45C 5/06; A45C 5/03; A45C 5/14; A45C 13/008; A45C 13/10; A45C 13/26; A45C 2005/037
See application file for complete search history.

(56) References Cited

U.S. PATENT DOCUMENTS

| | | | | |
|---|---|---|---|---|
| 186,105 | A * | 1/1877 | Bristol | E05D 5/08 16/382 |
| 782,685 | A * | 2/1905 | Nelson | E05D 5/0246 16/382 |
| 1,924,494 | A * | 8/1933 | Gelinas | F25D 3/08 217/7 |
| 3,169,615 | A * | 2/1965 | Stein | A45C 13/005 190/125 |
| 4,241,833 | A * | 12/1980 | Luebcke | A61F 17/00 312/902 |
| 4,385,580 | A * | 5/1983 | Davidson | E06B 5/01 114/201 R |
| 4,966,258 | A * | 10/1990 | Hawley | A45C 9/00 190/18 R |
| 6,736,265 | B2 * | 5/2004 | Kipper | B25H 3/028 206/811 |
| 9,486,046 | B2 * | 11/2016 | Krulik | A45C 5/03 |
| 10,182,628 | B2 * | 1/2019 | Tonelli | B25H 3/028 |
| 10,624,431 | B2 * | 4/2020 | Korey | A45C 5/06 |
| 10,772,402 | B2 * | 9/2020 | Sheikh | A45C 5/03 |
| 12,121,124 | B2 * | 10/2024 | Lin | A45C 13/007 |
| 2019/0313752 | A1 * | 10/2019 | Luo | A45C 13/04 |

FOREIGN PATENT DOCUMENTS

| | | |
|---|---|---|
| CN | 203952695 U | 11/2014 |
| CN | 209300362 U | 8/2019 |
| CN | 216123951 U | 3/2022 |

* cited by examiner

*Primary Examiner* — Tri M Mai
(74) *Attorney, Agent, or Firm* — George D. Morgan

(57) ABSTRACT

The present disclosure provide multifunctional luggage. The multifunctional luggage includes a cabinet, the cabinet includes a storage cavity in the cabinet, configured to storage articles; a holding slot provided on a front wall of the cabinet, configured to storage articles, and a front covering plate configured to cover the holding slot, the front covering plate being rotatably connected to a bottom of the cabinet.

14 Claims, 10 Drawing Sheets

MULTIFUNCTIONAL LUGGAGE

CROSS-REFERENCE TO RELATED APPLICATIONS

This present application claims the benefit of priority to Chinese Utility Model application No. CN202322815546.X, filed on Oct. 19, 2023, and Chinese Utility Model application No. CN202420688110.0, filed on Apr. 3, 2024, the disclosure of which is incorporated herein by reference in its entirety for all purposes.

TECHNICAL FIELD

The present disclosure relates to the field of luggage, in particular, relates to a multifunctional luggage.

BACKGROUND

Luggage is a box for placing articles that people carry when they go out, which can be used to store clothes, food and personal care products needed on the journey, etc., and is the most common storage tool used by people when they go out.

Existing luggage function is relatively single. For example, the absence of an independent placement space, so that the commonly used articles and laptop computers, tablet computers and other electronic products can only be put into the inside of the luggage like clothing and other ordinary articles. At the process of going out, if you want to access commonly used articles or electronic products, you have to open the whole luggage, it is very inconvenient, and personal belongings are easily exposed and privacy is not enough.

SUMMARY

The present disclosure provides a multifunctional luggage so as to solve the problem in the prior art in which it is necessary to open the luggage in order to access articles, resulting in the exposure of private articles placed in the storage cavity of the luggage.

The present disclosure provides a multifunctional luggage, including a cabinet, the cabinet includes a storage cavity, a holding slot and a front covering plate. The storage cavity is in the cabinet, and configured to storage articles; the holding slot is provided on a front wall of the cabinet, and configured to storage articles; and the front covering plate is configured to cover the holding slot, the front covering plate being rotatably connected to a bottom of the cabinet.

In some embodiments, as the above multifunctional luggage, the holding slot includes a first groove and a storage slot provided on a bottom wall of the first groove, the front covering plate being configured to cover the first groove and close the storage slot.

In some embodiments, as the above multifunctional luggage, the first groove includes a waterproof stopper surrounding the storage slot, the waterproof stopper being flush with a sidewall of the storage slot.

In some embodiments, as the above multifunctional luggage, the front covering plate includes a first sealer, a outer sidewall of the first sealer abutting a inner sidewall of the first groove.

In some embodiments, as the above multifunctional luggage, the cabinet includes a second groove opened on the the front wall of the cabinet, the holding slot being provided on a bottom wall of the second groove, the front covering plate including a second sealer affixed to a inner wall of the second groove.

In some embodiments, as the above multifunctional luggage, the multifunctional luggage further includes a first connecting portion connected to a inner wall of the first groove and a second connecting portion connected to a rear side of the front covering plate on a rear side of the cover plate, the first connecting portion being detachably connected to the second connecting portion.

In some embodiments, as the above multifunctional luggage, the front covering plate includes a first dogging, a camlock slot configured to being inserted by the first dogging being provided within the first groove, a second dogging being provided within the camlock slot, the first dogging snap-fitted to the second dogging after being inserted into the camlock slot.

In some embodiments, as the above multifunctional luggage, a lower side end of the first groove passes through the bottom of the cabinet, a seam being provided at a junction of the front covering plate with the bottom of the cabinet.

In some embodiments, as the above multifunctional luggage, the front wall of the cabinet includes a lateral covering seam, a upper cover plate being rotatably connected to a top of the cabinet, the upper cover plate including a first bending portion configured to cover the covering seam to prevent water from flowing from the covering seam into the holding slot.

In some embodiments, as the above multifunctional luggage, the front covering plate includes a handle.

In some embodiments, as the above multifunctional luggage, the multifunctional luggage further includes a rotating mechanism including a second connecting structure, a third connecting structure, and a connecting shaft, the second connecting structure being configured to fixedly connect to the bottom of the front covering plate, the third connecting structure being configured to connect to the cabinet, and the second connecting structure and the third connecting structure rotatably connected by the connecting shaft.

In some embodiments, as the above multifunctional luggage, the second connecting structure includes a plurality of first sleeves, and the third connecting structure includes a plurality of second sleeves, the first sleeves being staggered with the second sleeves, and the connecting shaft passes through the first sleeves and the second sleeves so that the second connecting structure is rotatably connected to the third connecting structure.

In some embodiments, as the above multifunctional luggage, the second connecting structure includes a third connecting portion, a fourth connecting portion, and a fifth connecting portion, the fourth connecting portion and the fifth connecting portion being located on both sides of the third connecting portion, respectively, the third connecting portion being fixedly connected to a inner bottom wall of the front covering plate, the fourth connecting portion and the fifth connecting portion being connected to a right side and a left side of the front covering plate, respectively.

In some embodiments, as the above multifunctional luggage, the first sealer is provided on a left side and the a right side of the front covering plate, the fourth connecting portion and the fifth connecting portion are provided on the rear side of the front covering plate, a third groove being provided on both the fourth connecting portion and the fifth connecting portion, and the first sealer being inserted in the third groove.

In some embodiments, as the above multifunctional luggage, the multifunctional luggage further includes a first fastener, and the third connecting portion includes a first mounting hole, the bottom of the front covering plate including a rearward extending a second bending portion, the second bending portion provided with a second mounting hole, the first fastener passing through the second mounting hole and the first mounting hole in turn to fix the third connecting portion and the second bending portion.

In some embodiments, as the above multifunctional luggage, the third connecting structure includes a fixing member and a connecting member, the fixing member being connected to the connecting member and forming a seam configured to place a bottom wall of the cabinet.

In some embodiments, as the above multifunctional luggage, the multifunctional luggage further includes a second fastener, and the connecting member includes a mounting pillar, the fixing member including a third mounting hole, the mounting pillar including a fourth mounting hole, the second fastener being mounted through the third mounting hole in the fourth mounting hole so that the fixing member and the connecting member are fixedly connected.

In some embodiments, as the above multifunctional luggage, the front covering plate includes a first corner at a lower end of the front covering plate and the second connecting structure has a second corner, a bottom edge of the second corner being located above a bottom edge of the first corner.

In some embodiments, as the above multifunctional luggage, the first corner includes a first left corner and a first right corner disposed on a left side and a right side of the front covering plate, respectively, the second corner includes a second left corner and a second right corner disposed on a left side and a right of a bottom of the fourth connecting portion and fifth connecting portion, respectively, the first left corner being disposed up and down arrangement with the second left corner, the first right corner being disposed up and down arrangement with the second right corner.

In an embodiment of the present disclosure, including the following beneficial effects.

In an embodiment of the present disclosure, inside the cabinet, there are two independent spaces, holding slot and storage cavity. The holding slot is opened or closed by the front covering plate, which is rotated and connected to the bottom of the cabinet to facilitate the opening of the holding slot. Some electronic products or frequently used articles can be placed inside the holding slot. When you need to use the articles in the holding slot, open the front covering plate so that articles can be quickly accessed and used without opening the storage cavity, avoiding the exposure of the privacy articles placed in the storage cavity. It protects the user's privacy, enhances the practicality of the product and helps to improve the competitiveness of the product.

BRIEF DESCRIPTION OF DRAWINGS

In order to more clearly illustrate the technical solutions in the embodiments or prior art of the present disclosure, the accompanying drawings that are required to be used in the description of the embodiments or prior art will be briefly described below, it will be obvious that the accompanying drawings in the following description are only some of the embodiments of the present disclosure, and it will be obvious to a person of ordinary skill in the art that other accompanying drawings can be obtained on the basis of these drawings without the expenditure of creative labour.

Wherein.

Wherein: 1, cabinet; 11, holding slot; 111, camlock slot; 12, waterproof stopper; 13, storage slot; 14, first groove; 15, second groove; 16, L-shaped foot pad; 2, front covering plate; 21, first sealer; 22, first dogging; 23, handle; 24, second sealer; 25, second bending portion; 251, second mounting hole; 26, first corner; 3, rotating mechanism; 31, connecting shaft; 32, second connecting structure; 321, third connecting portion; 3211, first mounting hole; 3212, first sleeve; 322, fourth connecting portion; 323, fifth connecting portion; 324, third groove; 325, second corner; 33, third connecting structure; 331, connecting member; 3311, mounting pillar; 3312, fourth mounting hole; 3313, second sleeve; 332, fixing member; 3321, third mounting hole; 4, upper cover plate; 41, first bending portion; 5, first connecting structure; 51, first connecting portion; 52, second connecting portion; 6, password lock; 7, switch; 8, transportation security administration.

DETAILED DESCRIPTION OF THE EMBODIMENTS

The technical solutions in the embodiments of the present disclosure will be described clearly and completely in the following in conjunction with the accompanying drawings in the embodiments of the present disclosure, and it is obvious that the described embodiments are only a part of the embodiments of the present disclosure, not all of the embodiments. Based on the embodiments in the present present disclosure, all other embodiments obtained by a person of ordinary skill in the art without making creative labor fall within the scope of protection of the present present disclosure.

In the description of the present present disclosure, it is to be understood that the terms "center", "longitudinal", "lateral", "length", "width", "thickness", "top", "bottom", "front", "back", "left", "right", "vertical", "horizontal", "top", "bottom", "inside", "outside", "clockwise", "counterclockwise" and the like indicate orientation or positional relationships based on those shown in the accompanying drawings, only for the purpose of facilitating the description of the present disclosure and simplifying the The description is only for the convenience of describing the present disclosure and simplifying the description, and is not intended to indicate or imply that the device or element referred to must have a specific orientation, be constructed and operated in a specific orientation, and therefore is not to be construed as a limitation of the present disclosure.

Furthermore, the terms "first" and "second" are used only for descriptive purposes and are not to be understood as indicating or implying relative importance or implicitly specifying the number of technical features indicated. Thus, the feature defined with "first", "second" may expressly or implicitly include one or more such features. In the description of the present disclosure, "more than one" means two or more, unless otherwise expressly and specifically limited.

Figure 1:
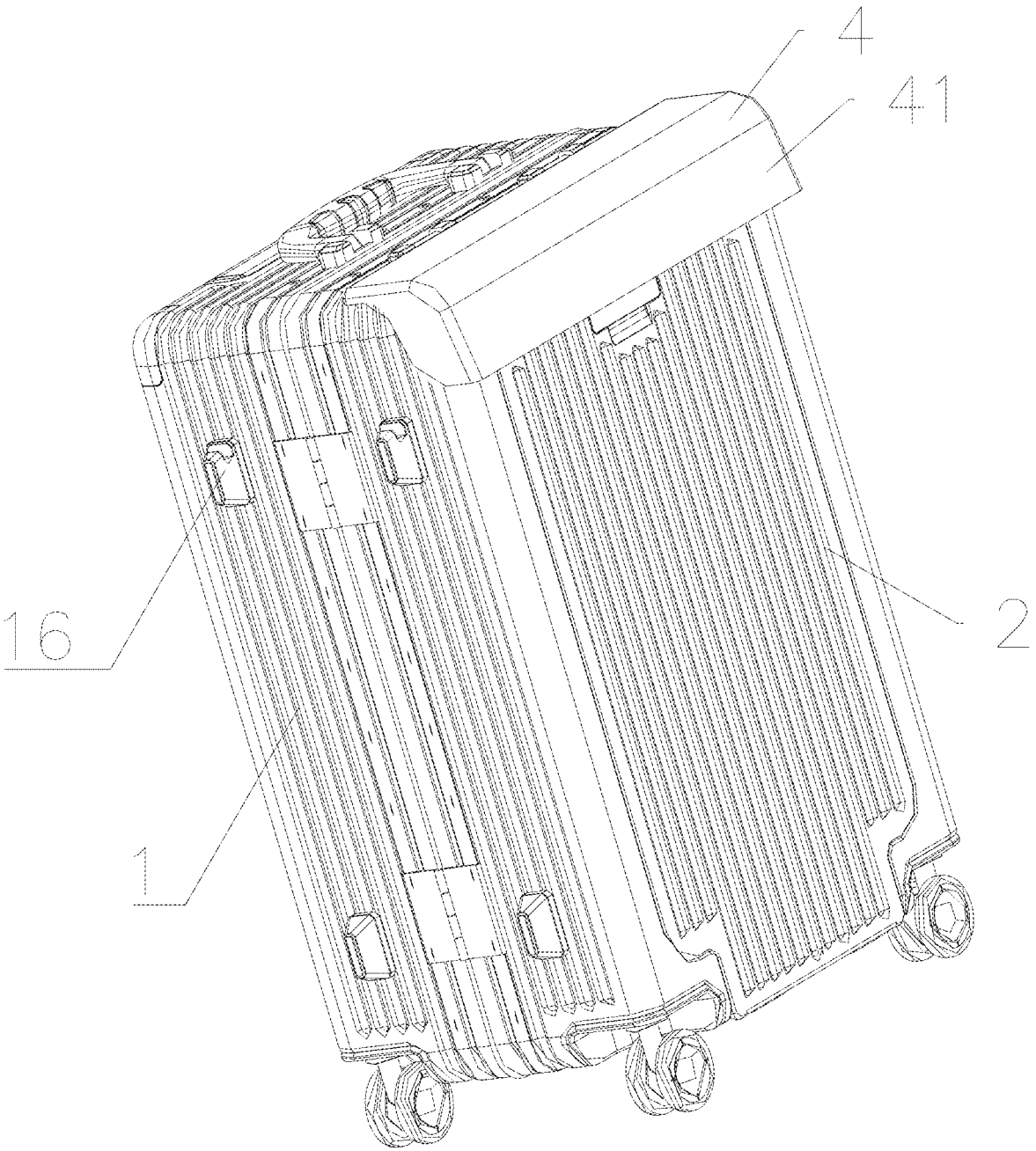
FIG. 1 is a schematic diagram of the structure of a multifunctional luggage according to an embodiment of the present disclosure.
Figure 2:
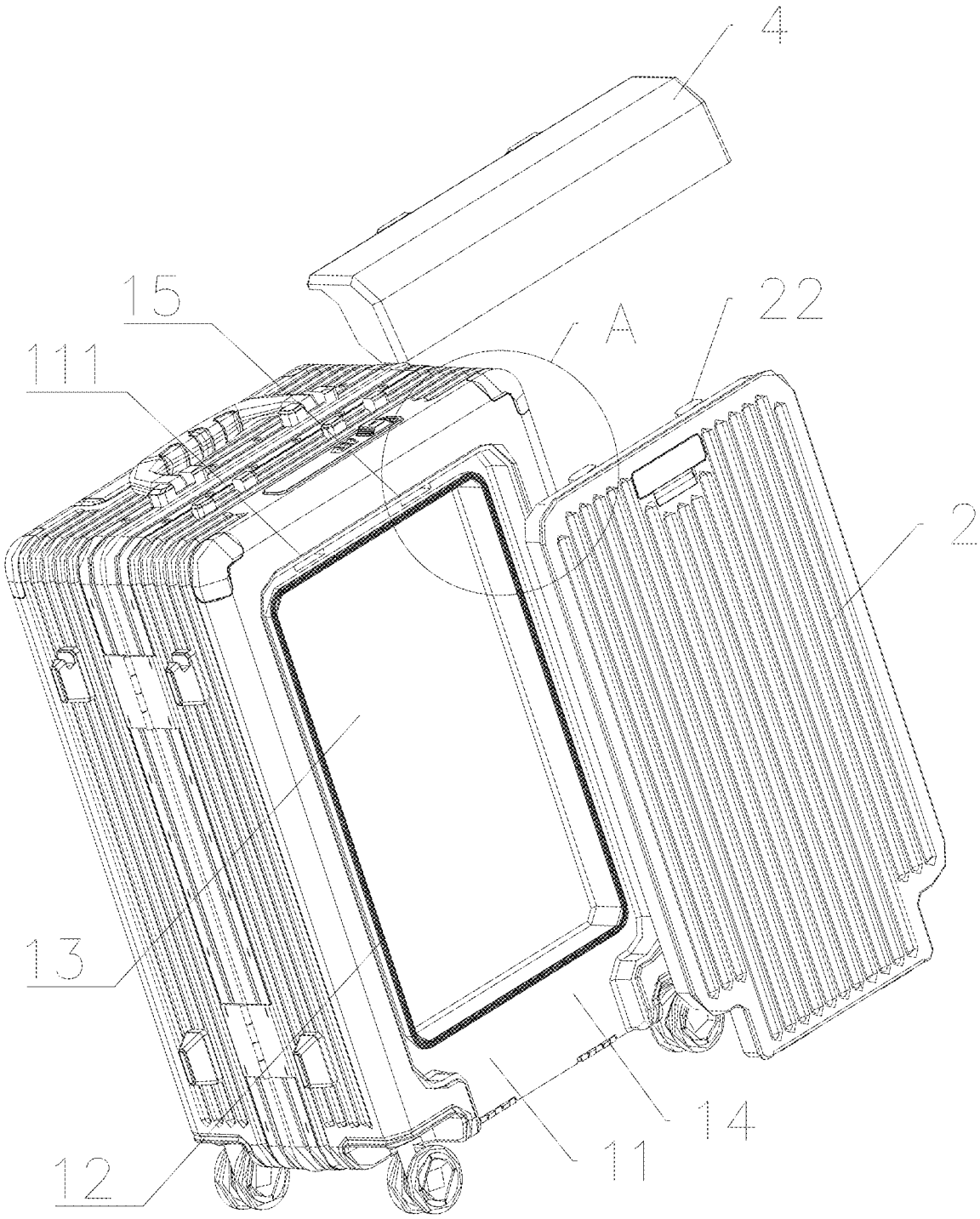
FIG. 2 is an exploded diagram of a multifunctional luggage according to an embodiment of the present disclosure.
Figure 3:
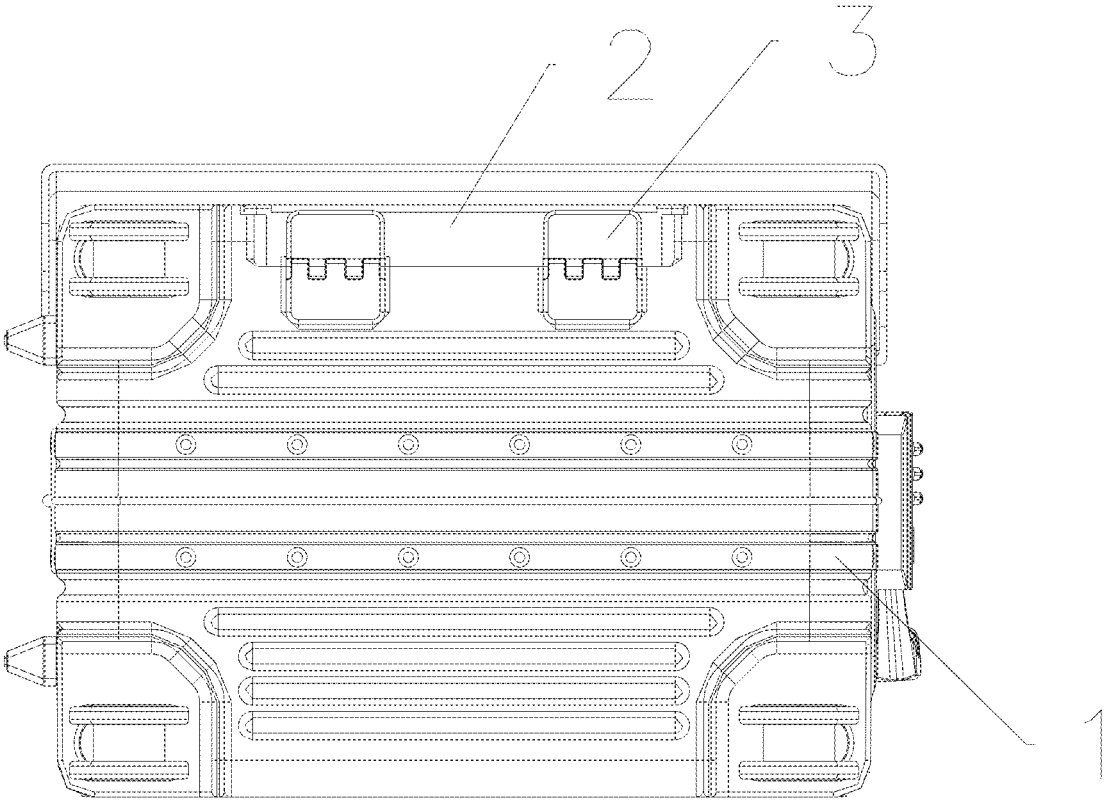
FIG. 3 is a elevation diagram of a multifunctional luggage according to an embodiment of the present disclosure.
Figure 4:
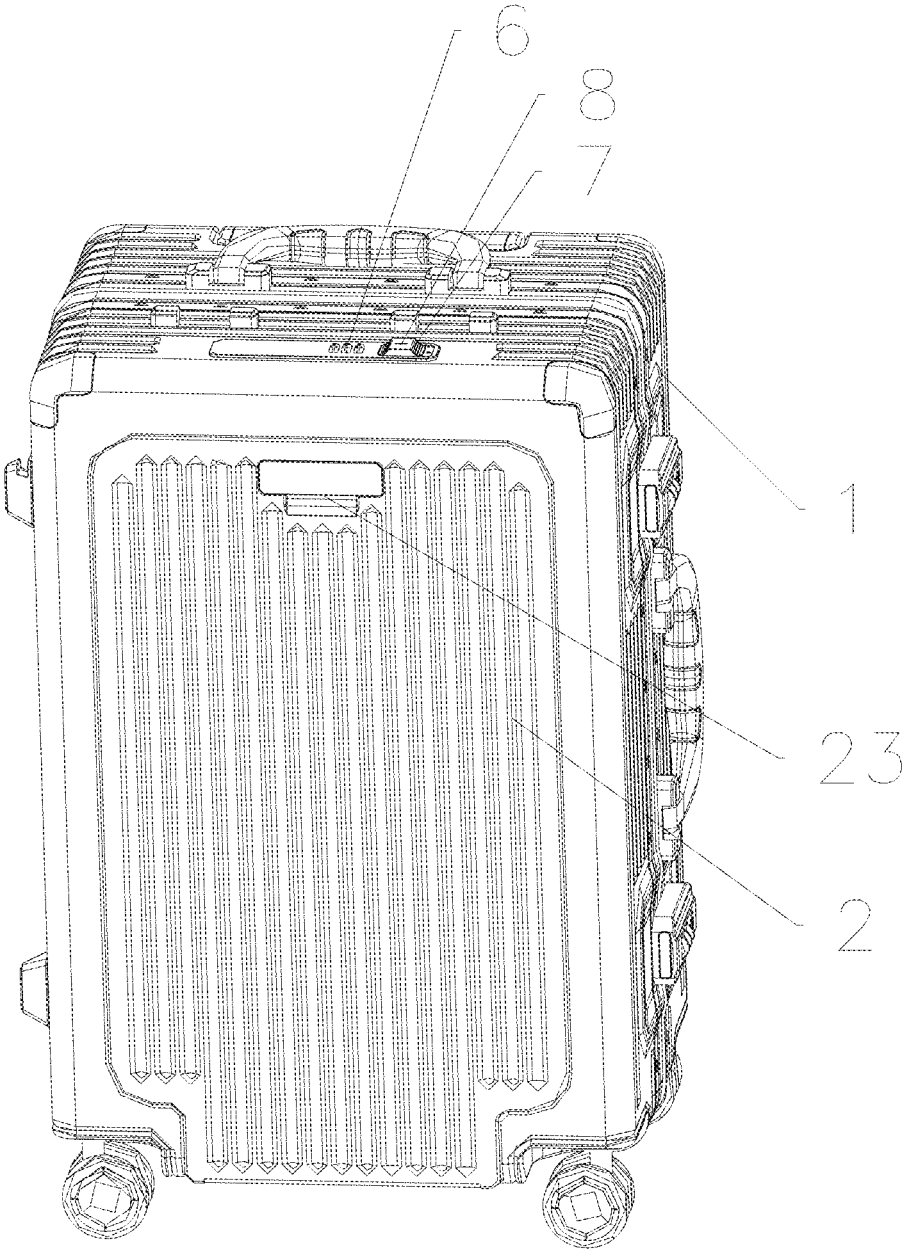
FIG. 4 is a schematic diagram of the structure of a cabinet and a front covering plate according to an embodiment of the present disclosure.
Figure 5:
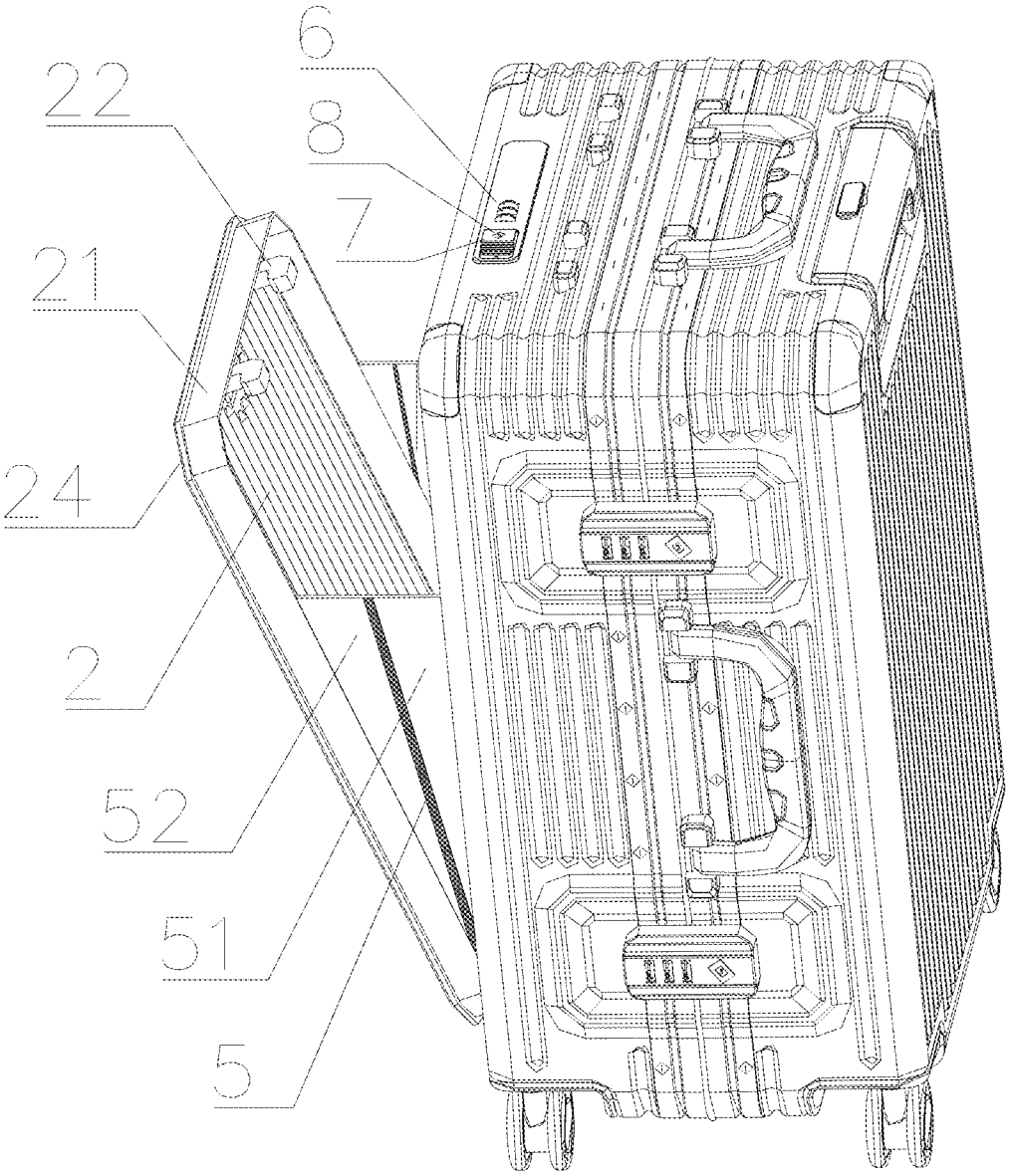
FIG. 5 is a schematic diagram of the structure of a cabinet and of a front covering plate when the front covering plate is open, according to an embodiment of the present disclosure.
Figure 6:
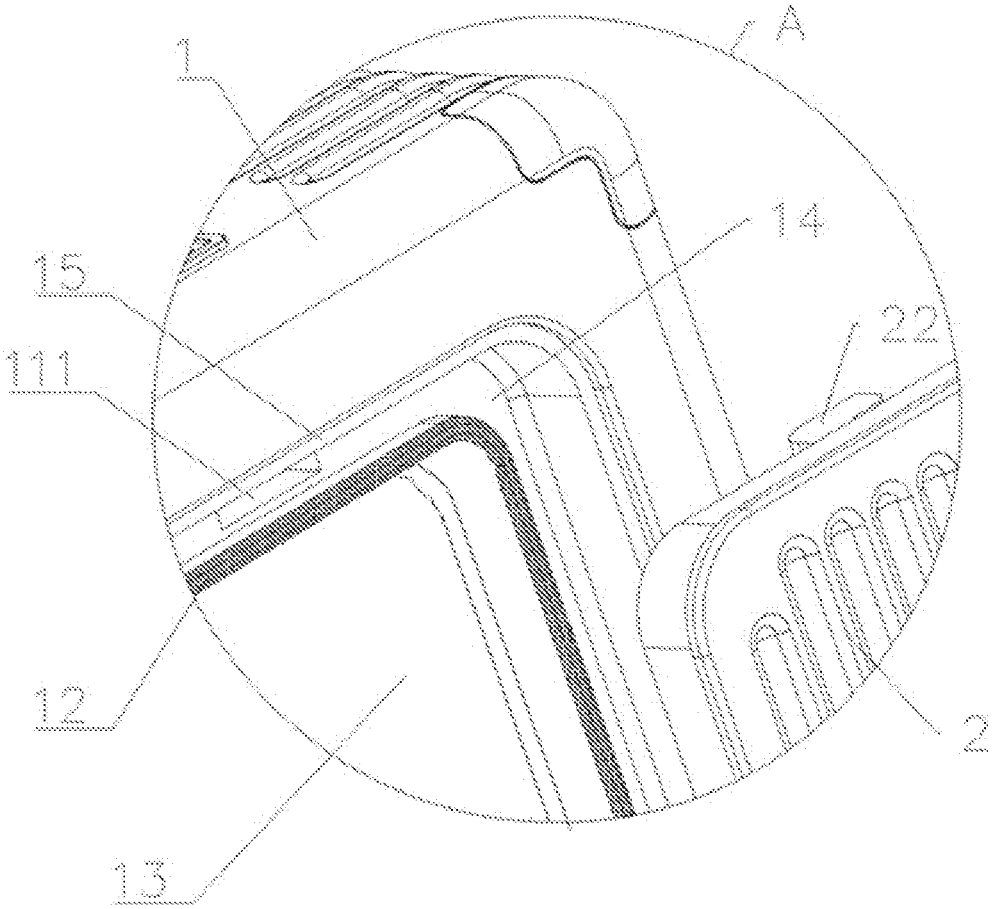
FIG. 6 is a enlarged diagram of part A in FIG. 2.
Figure 7:
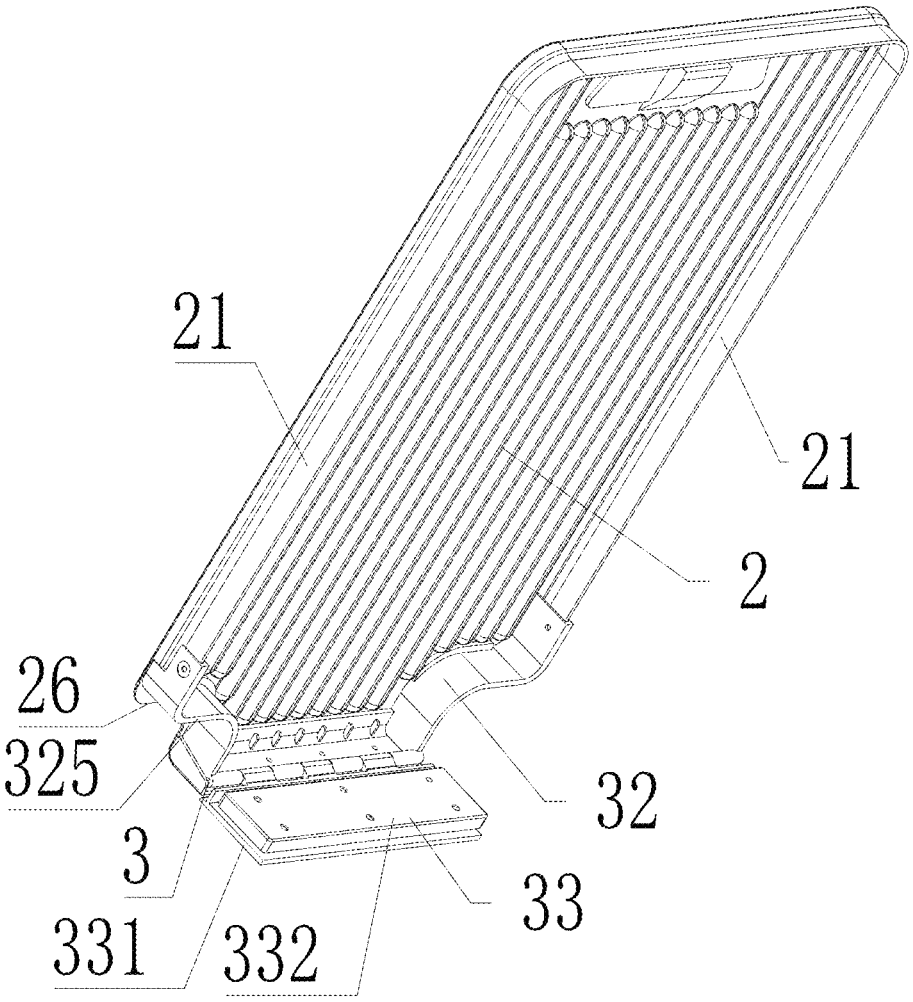
FIG. 7 is a schematic diagram of the structure of a front covering plate and a rotating mechanism according to an embodiment of the present disclosure.
Figure 8:
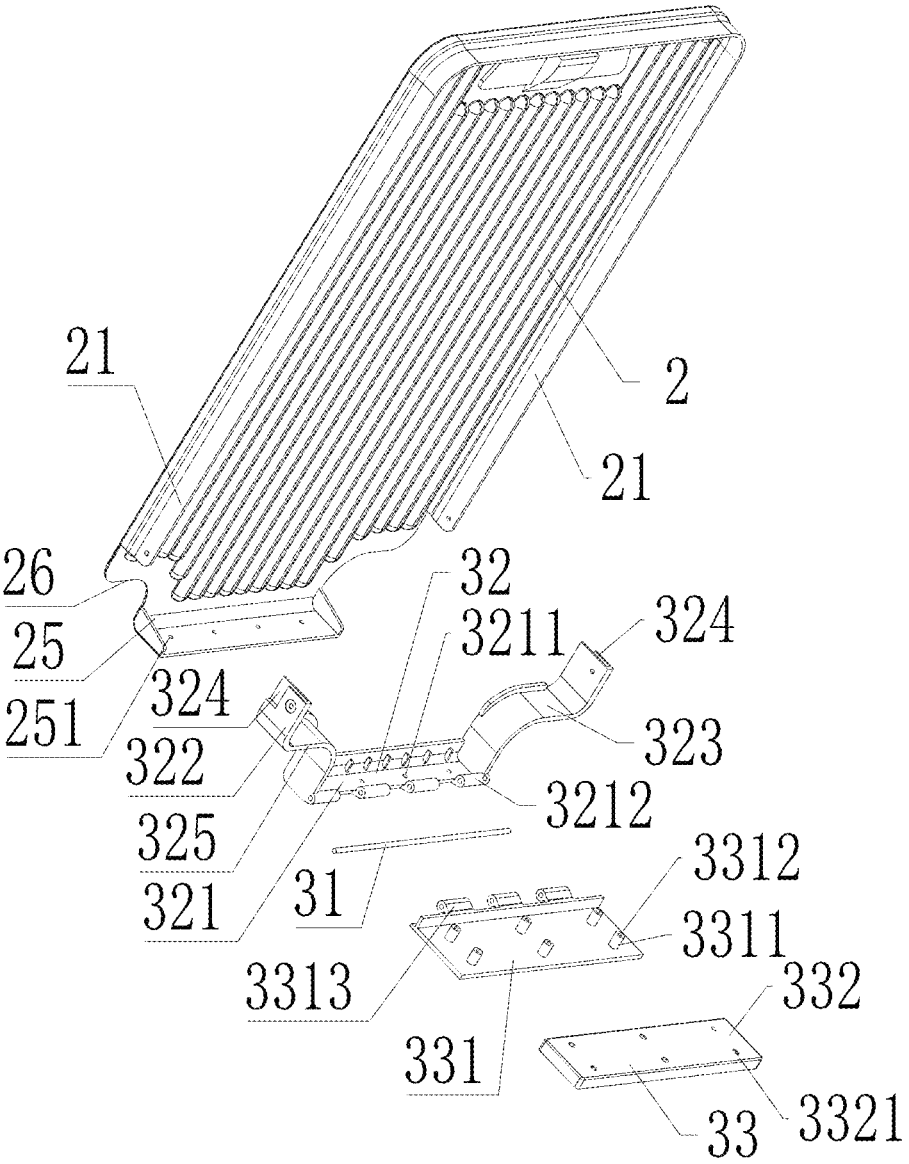
FIG. 8 is an exploded diagram of a front covering plate and a rotating mechanism according to an embodiment of the present disclosure.
Figure 9:
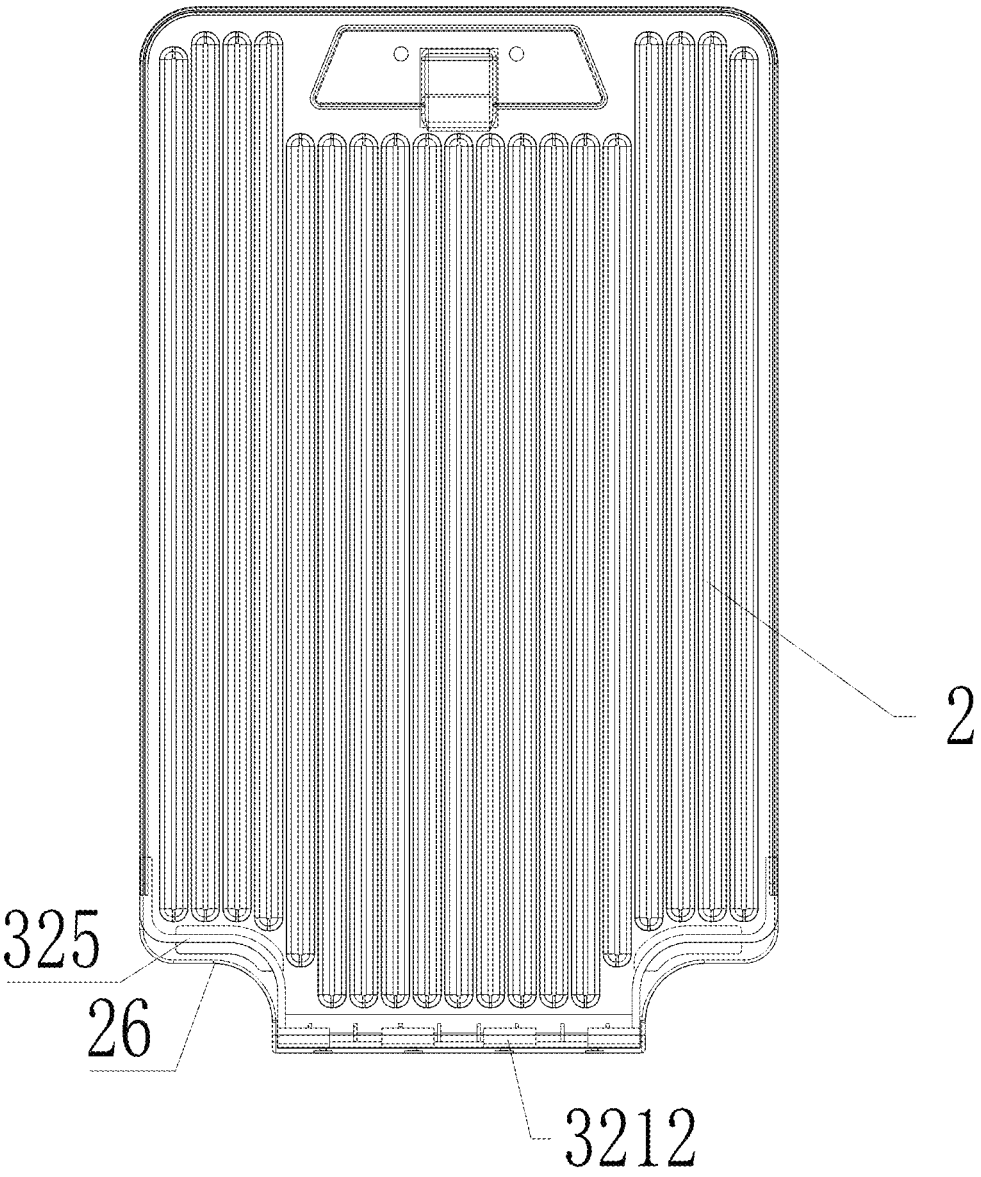
FIG. 9 is a rear diagram of a front covering plate and a rotating mechanism according to an embodiment of the present disclosure.
Figure 10:
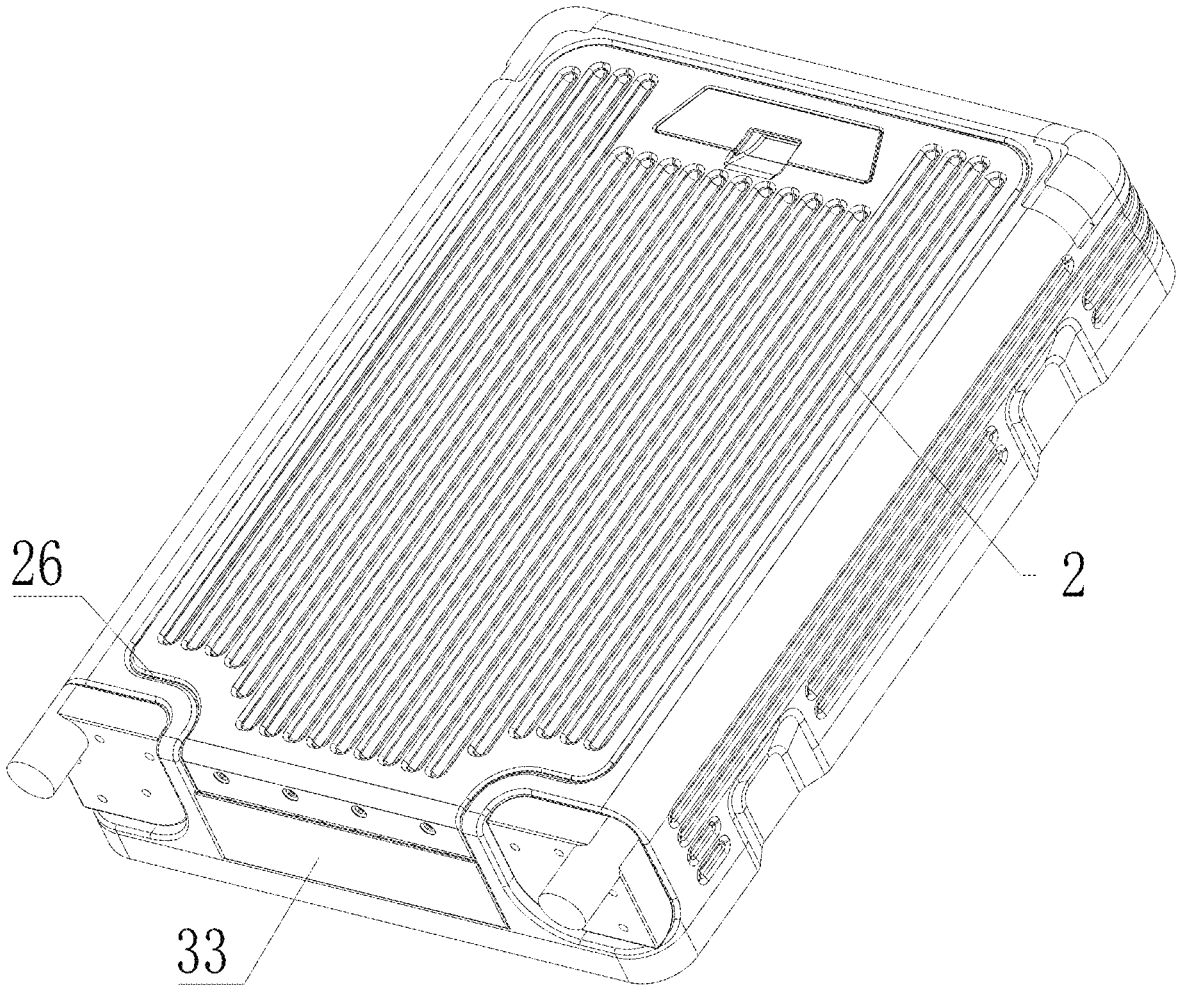
FIG. 10 is a schematic diagram of the structure of a cabinet and a front covering plate according to an embodiment of the present disclosure.

Refer to FIGS. 1-10, the present disclosure provides a multifunctional luggage including a cabinet1, the cabinet 1 includes a storage cavity configured to storage articles. The cabinet 1 also includes a holding slot 11 configured to storage articles, the holding slot 11 is a separate space, which can be used for placing some electronic products or frequently used articles. A front covering plate 2 is rotatably connected to a bottom of the cabinet 1 and configured to cover the holding slot 11. When using the multifunctional luggage, privacy articles can be placed in the storage cavity, and frequently used articles and electronic products can be placed in the holding slot 11, and when the articles in the holding slot 11 need to be accessed, the front covering plate 2 can be opened for quickly access and quickly use without opening the storage cavity. It avoids the exposure of private articles placed in the storage cavity, protects the user's privacy, enhances the practicality of the product, and helps to improve the competitiveness of the product.

Further, the holding slot 11 includes a first groove 14 and a storage slot 13 opened on a bottom wall of the first groove 14, the front covering plate 2 being configured to cover the first groove 14 and seal the storage slot 13, which can prevent water from entering to the storage slot 13; the first groove 14 is provided with a waterproof stopper 12 surrounding the storage slot 13, the waterproof stopper 12 is flush with a sidewall of the storage slot 13, the waterproof stopper12 is of thin-walled construction, and configured to prevent water from entering to the storage slot 13; the front covering plate 2 is provided with a first sealer 21, and when the front covering plate 2 is closed, the top side, the left side, and the right side of the inner sidewall of first sealer 21 are affixed to the outer sidewall of the waterproof stopper 12, the outer sidewall of the waterproof stopper 12 is affixed to the inner sidewall of the first groove14. When there is water flowing into the first groove 14, due to the structural design of the first sealer 21 and the waterproof stopper 12, the water will first be blocked by the first sealer 21, and then blocked by the waterproof stopper 12. Ultimately the water will flow along the outer sidewall of the first sealer 21 or the outer sidewall of the waterproof stopper12, into the bottom of the first groove 14 and then discharged outside, and cannot flow into the storage slot 13, thereby safeguarding the dryness of the interior of the storage slot 13 and avoiding damage to the articles placed therein.

Further, a second groove 15 is opened on the front wall of the cabinet 1, the holding slot 11 is provided on the bottom wall of the second groove 15. The front covering plate 2 is provided with a second sealer 24. The second sealer24 is affixed to the inner wall of the second groove 15 to make the front covering plate 2 and the cabinet 1 cover closer, reduce seams, and help to prevent water from flowing into the holding slot 11. When the front covering plate 2 is covered, the front end plane of the front covering plate 2 is flush with the front end plane of the cabinet 1. The front end plane of the front covering plate 2 is flush with the front end plane of the cabinet 1 so that the whole luggage is more flat and beautiful.

Further, a lower lateral end of the first groove 14 extends through the bottom of the cabinet 1 and forms a connecting edge with the bottom surface of the cabinet 1, the lower end of the first groove 14 forms a yielding groove, the front covering plate 2 is connected to the connecting edge and covers the yielding groove, and the front covering plate 2 is connected to the connecting edge with a seam. When water flows into the first groove 14, the water is able to flow along the inner wall of the first groove 14 and is finally discharged from the seam at the connection between the front covering plate 2 and the cabinet 1, avoiding the water from accumulating in the holding slot 11.

Further, the front covering plate 2 forms a lateral covering seam on the front wall of the cabinet 1 when the front covering plate 2 is covered on the holding slot 11. A upper cover plate 4 is rotatably connected to the top of the cabinet 1, the upper cover plate 4 is provided with a first bending portion 41 and in a shape of a "7". When the upper cover plate 4 is covered, the first bending portion 41 covers the outer side of the covering seam, and another part of the upper cover plate is located at the top of the cabinet 1, the upper cover plate 4 also covers the box edge between the top wall and the front wall of the cabinet 1, which can effectively prevent water from flowing from the top of the cabinet 1 along the outer wall of the cabinet 1 into the covering seam, and thus into the holding slot 11.

Further, a first dogging 22 is provided on the front covering plate 2, the first dogging 22 is disposed on the first sealer 21, and a camlock slot 111 is provided in the first groove 14 configured to be inserted by the first dogging 22. The camlock slot 111 is provided with a second dogging, and the first dogging 22 is snap-fitted to the second dogging after being inserted into the camlock slot 111.

Further, a switch 7 is also provided on a snapping surface of the front covering plate 2 and the cabinet 1. Pushing the switch 7 can disengage the second dogging from the first dogging 22 to open the front covering plate 2. The switch 7 is also equipped with a password lock 6, which needs to be decrypted before pushing switch 7 to protect the security of the articles in the luggage. The switch 7 is also equipped with a transportation security administration 8, which facilitates the insertion of a special key for customs to insert the transportation security administration 8 to open the front covering plate 2 during customs inspection without prying open and damaging the luggage.

Further, the multifunctional luggage also includes a first connecting structure 5, the first connecting structure 5 includes a first connecting portion 51 connected to the inner wall of the first groove1 4 and a second connecting portion 52 connected to the rear side of the front covering plate 2, the first connecting portion 51 and the second connecting portion 52 being detachably connected. The first connecting portion 51 and the second connecting portion52 are connected by a zipper; it is also possible to provide a hair portion on the first connecting portion 51 or the second connecting portion 52, and a hook portion on the second connecting portion 52 or the first connecting portion 51. The connection between first connecting portion 51 and second connecting portion 52 is realized by connecting the hook portion to the hair portion. The first connecting portion 5 can limit the opening angle of the front covering plate 2 to prevent the front covering plate2 from sliding down when the article is taken away. When the first connecting portion 51 is disassembled from the second connecting portion 52, the front covering plate 2 can be completely opened.

Further, the front covering plate 2 is provided with a handle 23, which facilitates the opening of the front covering plate 2, and when the front covering plate 2 needs to be opened, the handle23 is pulled, and the handle 23 is designed to facilitate the application of force by the user for easy operation.

Further, the front covering plate 2 and the bottom of the cabinet 1 are connected by the rotating mechanism 3. The rotating mechanism 3 is preferably a hinge type hinge, the hinge has two rotating blocks, one of the rotating blocks is fixed to the bottom of the cabinet 1, the other rotating block is fixed to the front covering plate 2. The two rotating blocks are connected by a pivot. Other rotating mechanism 3 may also be used. By setting the hinge at the bottom of the cabinet, the user cannot see the hinge at the bottom of the cabinet when the luggage is being put in the upright position, so as to make the whole luggage more concise and to enhance the aesthetics of the luggage.

Further, a plurality of compartments are provided in the storage slot 13, and the compartments may be cloth bags or mesh pockets with elasticity, which are used for storing frequently used articles and electronic products such as laptop computers and tablet computers, so as to facilitate item categorization.

Further, a first carrying handle is provided on the top of the cabinet 1, and a second carrying handle is provided on the left sidewall or the right sidewall of the cabinet 1. It provides horizontal and vertical carrying methods for the user to choose. A transportation security is also provided on the side having the second carrying handle to restrict the opening of the storage cavity. An L-shaped foot pad 16 is provided on the left or right sidewall without the handle to hang articles and to provide support and protection when the articles are placed on its side.

Further, crash packs are provided at each of the eight corners of the cabinet 1 to reduce damage brought about by collision of the cabinet 1.

Further, the multifunctional luggage further includes a rotating mechanism 3. The rotating mechanism 3 includes a second connecting structure 32, a third connecting structure 33, and a connecting shaft 31, the second connecting structure 32 is fixedly connected to the bottom of the front covering plate 2, the third connecting structure 33 is configured to connect to the cabinet 1, the second connecting structure 32 and the third connecting structure 33 is rotatably connected by the connecting shaft 31 so as to realize the rotatably connection between the front covering plate 2 and luggage cabinet 1. The junction between the front covering plate 2 and cabinet 1 becomes a stress point of the whole front covering plate 2, i.e. the whole connecting shaft 31 is the stress point of the front covering plate 2, providing sufficient support for the front covering plate 2, so that when opening the front covering plate 2, the front covering plate 2 will not sink downward, making the opening and closing of the front covering plate 2 smoother and more convenient, thereby enhancing the user experience.

Further, the second connecting structure 32 is provided with a plurality of first sleeves 3212, the third connecting structure 33 is provided with a plurality of second sleeves 3313, and the first sleeve 3212 is connected to the second sleeve 3313. The first sleeve 3212 and the second sleeve 3313 are staggered, the connecting shaft 3 passing through the first sleeve 3212 and the second sleeve 3313 to enable the second connecting structure 32 to be rotatably connected to the third connecting structure 33. The first sleeve 3212 and the second sleeve 3313 are staggered and then connected by connecting shaft 31 to better support the front covering plate 2 and prevent the front covering plate 2 from sinking due to gravity, resulting in difficulty in fastening the front covering plate 2.

Further, the second connecting structure 32 includes a third connecting portion 321, a fourth connecting portion 322 and a fifth connecting portion 323, the fourth connecting portion 322 and the fifth connecting portion 323 being located on both sides of the third connecting portion 321, respectively. The third connecting portion 321 being fixedly connected to a inner bottom wall of the front covering plate 2, the fourth connecting portion 322 and the fifth connecting portion 323 being connected to a right side and a left side of the front covering plate 2, respectively. Specifically, the third connecting portion 321, the fourth connecting portion 322, and the fifth connecting portion 323 are of one-piece molded construction.

Further, the first sealer 21 is provided on the left side and right side of the front covering plate 2, the fourth connecting portion 322 and the fifth connecting portion 323 are located on the rear side of the front covering plate 2, both the fourth connecting portion 322 and the fifth connecting portion 323 are provided with third groove 324. The first sealer 21 is inserted into the third groove 324 and then fixedly connected the first sealer 21 to the fourth connecting portion 322, and fifth connecting portion 323 by screws.

Further, the multifunctional luggage further includes a first fastener, preferably a screw, the third connecting portion 321 is provided with a first mounting hole 3211, and the second bending portion 25 is provided at the bottom of the front covering plate 2 extending rearwardly. The second bending portion 25 is provided with a second mounting hole 251, the first fastener passes through the second mounting hole 251 and the first mounting hole 3211 in turn to fix the the second connecting structure 32 to the second bending portion 25.

Further, the third connecting structure 33 includes a fixing member 332 and a connecting member 331, the fixing member 332 being connected to the connecting member 331 and forming a seam for placing the bottom wall of the cabinet 1. The fixing member 332 being connected to the connecting member 331 can better support the connecting member 331 and enhance the strength of the third connecting structure 33, avoiding the bottom of the luggage from being easily damaged due to long-term stress.

Further, a second fastener, preferably a screw, is included in the multifunctional luggage. The connecting member 331 is provided with a mounting pillar 3311, the fixing member 332 is provided with a third mounting hole 3321, the mounting pillar 3311 is provided with a fourth mounting hole 3312, the second fastener being mounted in the fourth mounting hole 3312 through the third mounting hole 3321 such that the fixing member 332 and the connecting member 331 are fixedly connected.

Further, the lower end portion of the front covering plate 2 has a first corner 26, the second connecting structure 32 is provided with a second corner 325, and a bottom edge of the second corner 325 is disposed on the bottom edge of the first corner 26, avoiding interference with the luggage to affect the opening and closing of the front covering plate 2, and also avoiding the seam between the front covering plate 2 and the luggage to be too large to affect the aesthetic appearance of the luggage when the front covering plate 2 covers the luggage.

Further, the first corner 26 includes a first left corner and a first right corner disposed on the left side and right side of the front covering plate 2, and the second corner 325 includes a first left corner and a first right corner disposed on the bottom of the fourth connecting portion 322 and fifth second corner 323, the first left corner being disposed in an up and down arrangement with the second left corner, and the first right corner being disposed in an up and down arrangement with the second right corner. The front covering plate 2 does not interfere with the luggage when it is opened and closed and the seam is smaller and more aesthetically pleasing when the cover is closed.

The above disclosure is only a better embodiment of the present disclosure, of course, can not be used to limit the scope of the rights of the present disclosure, so in accordance with the claims of the present disclosure to make the equivalent changes, is still covered by the scope of the present disclosure.

What is claimed is:

1. A multifunctional luggage, comprising a cabinet, wherein the cabinet comprises:

a storage cavity in the cabinet, configured to storage articles;

a holding slot provided on a front wall of the cabinet, configured to storage articles, and a front covering plate configured to cover the holding slot, the front covering plate being rotatably connected to a bottom of the cabinet, the holding slot comprises a first groove and a storage slot provided on a bottom wall of the first groove, the front covering plate being configured to cover the first groove and close the storage slot, the front covering plate comprises a first sealer, an outer sidewall of the first sealer abutting an inner sidewall of the first groove, the multifunctional luggage further comprises a rotating mechanism including a second connecting structure, a third connecting structure, and a connecting shaft, the second connecting structure being configured to fixedly connect to the bottom of the front covering plate, the third connecting structure being configured to connect to the cabinet, and the second connecting structure and the third connecting structure rotatably connected by the connecting shaft, the second connecting structure comprises a plurality of first sleeves, and the third connecting structure comprises a plurality of second sleeves, the first sleeves being staggered with the second sleeves, and the connecting shaft passes through the first sleeves and the second sleeves so that the second connecting structure is rotatably connected to the third connecting structure, wherein the second connecting structure comprises a third connecting portion, a fourth connecting portion, and a fifth connecting portion, the fourth connecting portion and the fifth connecting portion being located on both sides of the third connecting portion, respectively, the third connecting portion being fixedly connected to a inner bottom wall of the front covering plate, the fourth connecting portion and the fifth connecting portion being connected to a right side and a left side of the front covering plate, respectively.

2. The multifunctional luggage according to claim 1, wherein the first groove comprises a waterproof stopper surrounding the storage slot, the waterproof stopper being flush with a sidewall of the storage slot.

3. The multifunctional luggage according to claim 1, wherein the cabinet comprises a second groove opened on the front wall of the cabinet, the holding slot being provided on a bottom wall of the second groove, the front covering plate including a second sealer affixed to an inner wall of the second groove when the front covering plate is covered.

4. The multifunctional luggage according to claim 1, wherein the multifunctional luggage further comprises a first connecting portion connected to an inner wall of the first groove and a second connecting portion connected to a rear side of the front covering plate on a rear side of the cover plate, the first connecting portion being detachably connected to the second connecting portion.

5. The multifunctional luggage according to claim 1, wherein the front covering plate comprises a first dogging, a camlock slot configured to being inserted by the first dogging being provided within the first groove, a second dogging being provided within the camlock slot, the first dogging snap-fitted to the second dogging after being inserted into the camlock slot.

6. The multifunctional luggage according to claim 1, wherein a lower side end of the first groove passes through the bottom of the cabinet, a seam being provided at a junction of the front covering plate with the bottom of the cabinet.

7. The multifunctional luggage according to claim 1, wherein the front wall of the cabinet comprises a lateral covering seam, a upper cover plate being rotatably connected to a top of the cabinet, the upper cover plate including a first bending portion configured to cover the covering seam to prevent water from flowing from the covering seam into the holding slot.

8. The multifunctional luggage according to claim 1, wherein the front covering plate comprises a handle.

9. The multifunctional luggage according to claim 1, wherein the first sealer is provided on a left side and a right side of the front covering plate, the fourth connecting portion and the fifth connecting portion are provided on the rear side of the front covering plate, a third groove being provided on both the fourth connecting portion and the fifth connecting portion, and the first sealer being inserted in the third groove.

10. The multifunctional luggage according to claim 1, wherein the multifunctional luggage further comprises a first fastener, and the third connecting portion comprises a first mounting hole, the bottom of the front covering plate including a rearward extending a second bending portion, the second bending portion provided with a second mounting hole, the first fastener passing through the second mounting hole and the first mounting hole in turn to fix the third connecting portion and the second bending portion.

11. The multifunctional luggage according to claim 1, wherein the third connecting structure comprises a fixing member and a connecting member, the fixing member being connected to the connecting member and forming a seam configured to place a bottom wall of the cabinet.

12. The multifunctional luggage according to claim 11, wherein the multifunctional luggage further comprises a second fastener, and the connecting member comprises a mounting pillar, the fixing member including a third mounting hole, the mounting pillar including a fourth mounting hole, the second fastener being mounted through the third mounting hole in the fourth mounting hole so that the fixing member and the connecting member are fixedly connected.

13. The multifunctional luggage according to claim 1, wherein the front covering plate comprises a first corner at a lower end of the front covering plate and the second connecting structure has a second corner, a bottom edge of the second corner being located above a bottom edge of the first corner.

14. The multifunctional luggage according to claim 13, wherein the first corner comprises a first left corner and a first right corner disposed on a left side and a right side of the front covering plate, respectively, the second corner comprises a second left corner and a second right corner disposed on a left side and a right of a bottom of the fourth connecting portion and fifth connecting portion respectively, the first left corner being disposed up and down arrangement with the second left corner, the first right corner being disposed up and down arrangement with the second right corner.

* * * * *